US009073612B2

(12) United States Patent
Lavorata et al.

(10) Patent No.: US 9,073,612 B2
(45) Date of Patent: Jul. 7, 2015

(54) DEVICE FOR STABILIZING AN INFLATABLE STRUCTURE

(75) Inventors: Marc Lavorata, Paris (FR); Pascal Michaud, Chevanceaux (FR); Franck Palomba, Paris (FR)

(73) Assignee: Survitec SAS, Chevanceaux (FR)

( * ) Notice: Subject to any disclaimer, the term of this patent is extended or adjusted under 35 U.S.C. 154(b) by 146 days.

(21) Appl. No.: 13/881,666

(22) PCT Filed: Feb. 4, 2011

(86) PCT No.: PCT/FR2011/050227

§ 371 (c)(1),
(2), (4) Date: Apr. 25, 2013

(87) PCT Pub. No.: WO2012/056130

PCT Pub. Date: May 3, 2012

(65) Prior Publication Data

US 2013/0220197 A1 Aug. 29, 2013

(30) Foreign Application Priority Data

Oct. 29, 2010 (FR) ..... 10 58956

(51) Int. Cl.

| | |
|---|---|
| ***B63B 39/03*** | (2006.01) |
| ***B63B 43/06*** | (2006.01) |
| ***B63B 13/00*** | (2006.01) |
| *B63B 7/08* | (2006.01) |

(52) U.S. Cl.

CPC ..... *B63B 43/06* (2013.01); *Y10T 156/10* (2015.01); *B63B 7/085* (2013.01); *B63B 13/00* (2013.01)

(58) Field of Classification Search

CPC ..... B63B 1/14; B63B 7/08; B63B 35/73; B63B 39/00; B63B 13/00; B63B 43/06; B63B 11/04; B63B 39/03; B63B 7/085; Y10T 156/10

USPC ..... 114/125, 121; 441/133, 134, 5, 37

See application file for complete search history.

(56) References Cited

U.S. PATENT DOCUMENTS

| | | | | |
|---|---|---|---|---|
| 3,448,712 | A * | 6/1969 | Adams, Jr. et al. | 114/259 |
| 4,919,067 | A | 4/1990 | Wenstob et al. | |
| 4,993,342 | A * | 2/1991 | Eymard | 114/140 |
| 5,544,612 | A | 8/1996 | Eymard | |
| 6,684,808 | B2 * | 2/2004 | Callahan | 114/311 |
| 2007/0232163 | A1 | 10/2007 | Larochelle et al. | |

FOREIGN PATENT DOCUMENTS

| | | |
|---|---|---|
| DE | 881 164 C | 6/1953 |
| DE | 912 426 C | 5/1954 |

(Continued)

*Primary Examiner* — S. Joseph Morano
*Assistant Examiner* — Anthony Wiest
(74) *Attorney, Agent, or Firm* — Patterson Thuente Pedersen, P.A.

(57) ABSTRACT

The device comprises at least one pair of flexible ballasts which extend laterally along the length of the inflatable structure and each comprise an orifice, acting as a vent, situated at the front, and a scoop system situated at the rear. Between the ballasts, at least one pipe connects the cavities of said ballasts to equalize their level of fill and the stagnation pressure of the water obtaining in said cavities when the inflatable structure is pulled along in the inflated state. This scoop system consists of a component moulded in a rigid or semirigid thermoplastic or is made of an assembly of cutouts from a flexible material of watertight fabric. This scoop system is bonded and/or welded to the ballast.

11 Claims, 6 Drawing Sheets

(56) References Cited

FOREIGN PATENT DOCUMENTS

| | | | |
|---|---|---|---|
| DE | 11 91 709 | B | 4/1965 |
| FR | 1 180 117 | A | 6/1959 |
| FR | 2 633 581 | | 1/1990 |
| WO | WO 00/00381 | A1 | 1/2000 |

* cited by examiner

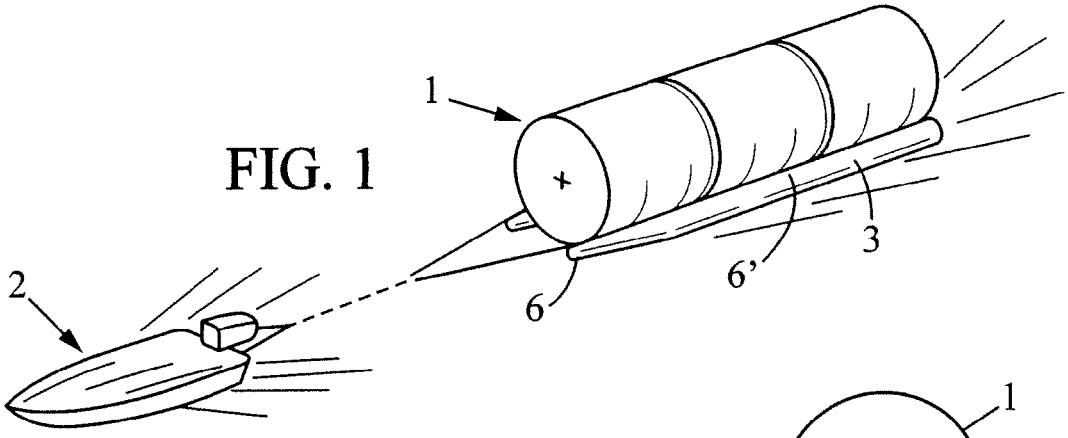
FIG. 1
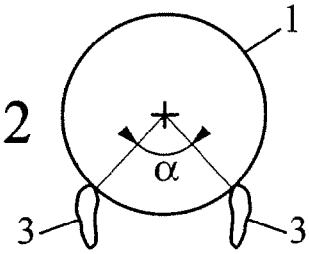
FIG. 2
FIG. 3
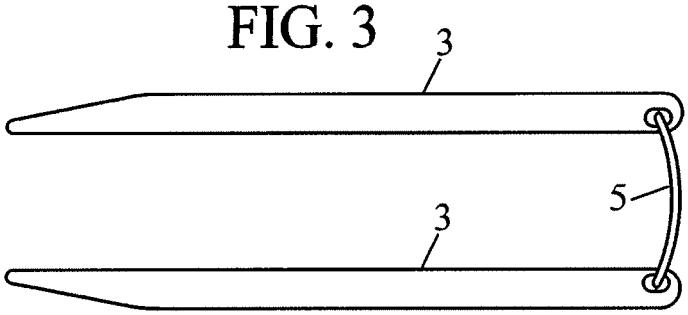
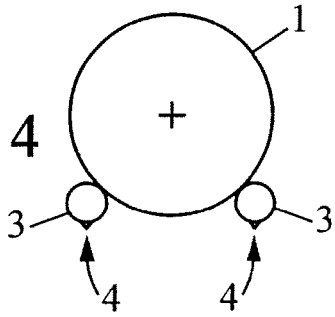
FIG. 4
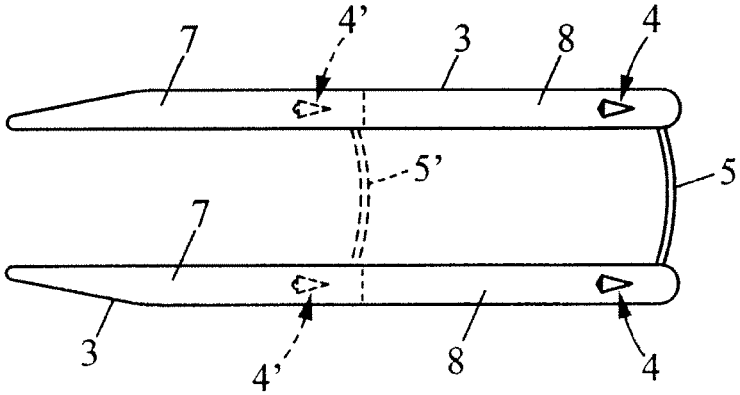
FIG. 5

FIG. 9
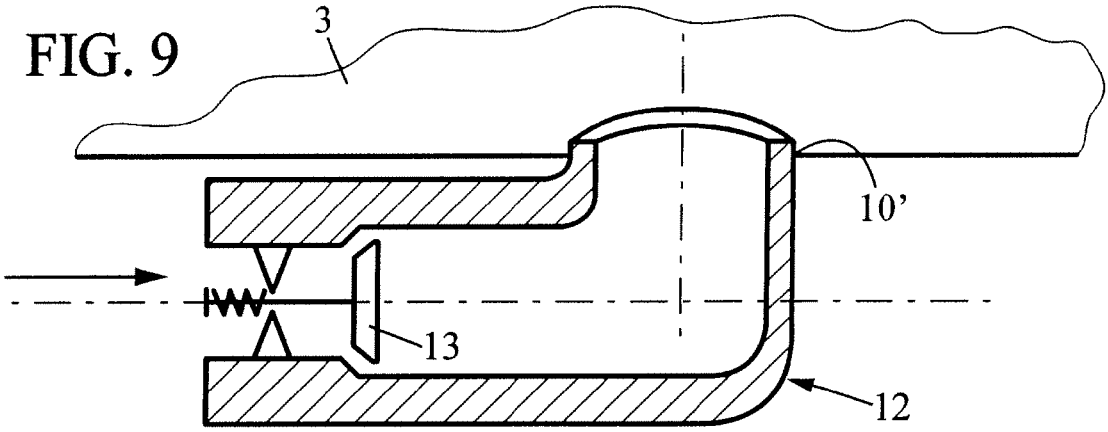
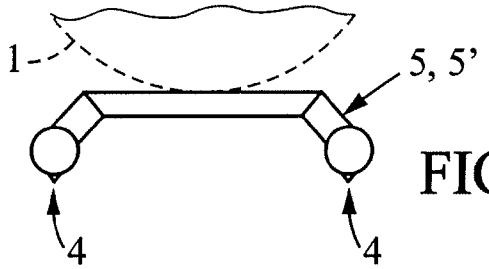
FIG. 10
FIG. 11
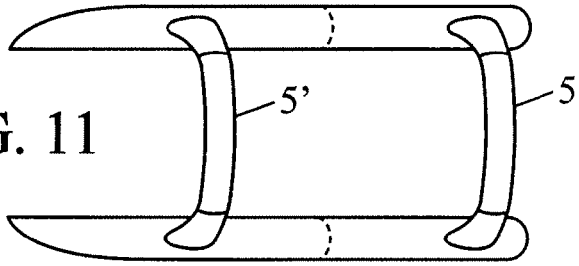
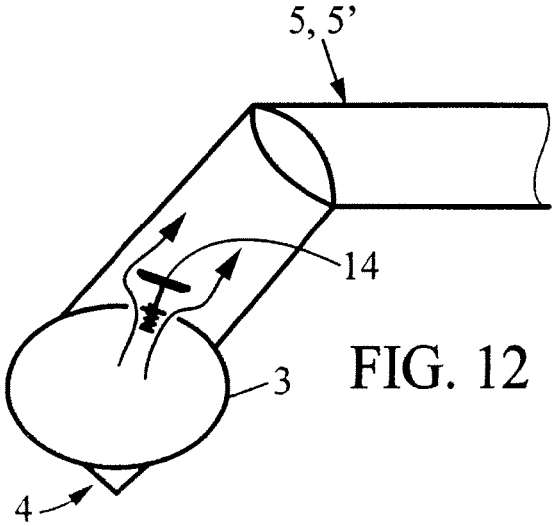
FIG. 12

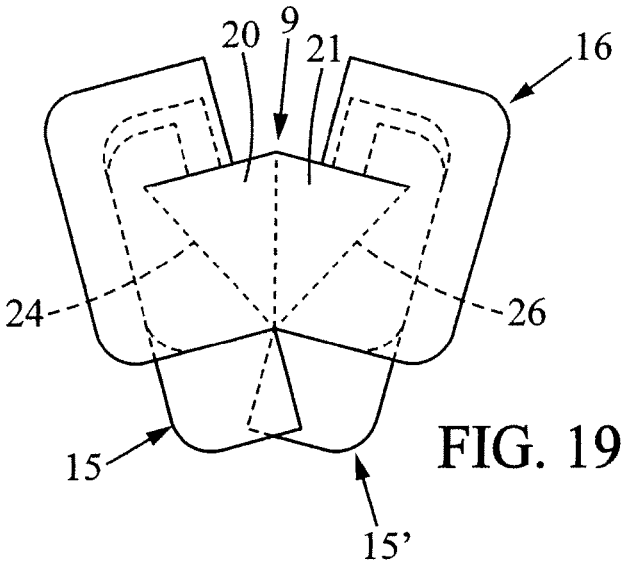
FIG. 19
FIG. 20
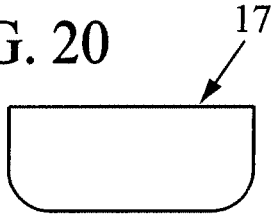
FIG. 22
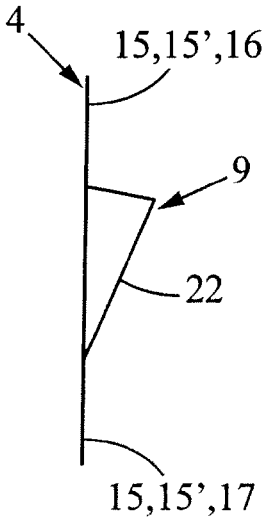
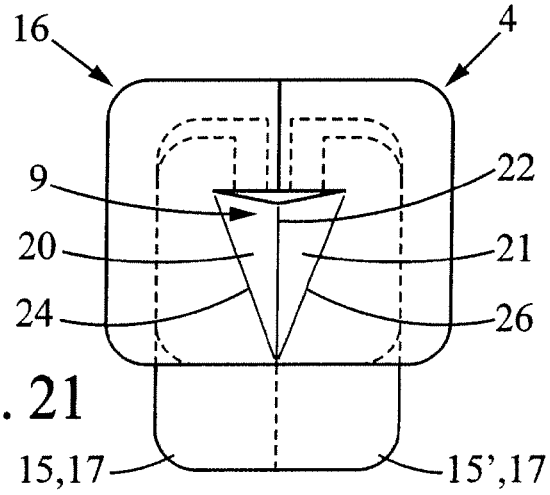
FIG. 21
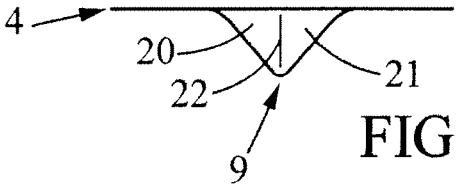
FIG. 23

DEVICE FOR STABILIZING AN INFLATABLE STRUCTURE

RELATED APPLICATIONS

The present application is a National Phase entry of PCT Application No. PCT/FR2011/050227, filed Feb. 4, 2011, which claims priority from FR Application No. 10 58956 filed Oct. 29, 2010, which applications are incorporated by reference herein in their entirety.

FIELD OF THE INVENTION

The present invention relates to a device for stabilizing an inflatable structure and in particular an inflatable structure intended to be pulled along in the inflated state by a motor boat.

BACKGROUND OF THE INVENTION

A floating inflated structure of cylindrical or similar shape does not have an inherent stability. It requires some sort of ballast in order to be able to take and hold its position, either in a static situation or even in a dynamic situation, during its movement over the water.

In certain conditions of use outside the water such as during periods of transport, for example, the ballast can constitute an inconvenience owing to its bulk and weight.

This problem can equally be found again on classic motor boats such as that described in the document FR 2 633 581. In this document the motor boat comprises a longitudinal keel which is mounted beneath and in the centre of the hull, the said keel being provided in the form of a cylindrical pocket formed with a deformable watertight flexible material which comprises at one of its ends an orifice acting as a vent, and at its other end a fitment in the form of a scoop in order to allow automatic refilling of this pocket with water and this as soon as the boat starts to move.

SUMMARY OF THE INVENTION

The present invention proposes a fitment of this type, but for an elongated inflatable structure in the form of a large cylinder which is intended to be pulled along, in the inflated state, by a boat. The inflated structure having a diameter in the order of 2 meters or more, for example, and it has to be stabilised on the water, notably when it is moved, pulled along by a motor boat.

The present invention proposes a simple efficient means enabling ballasting of this inflatable structure so as to rapidly obtain sufficient stability which enables it to follow a safe trajectory, corresponding to that of a more classic type of motor boat, for example as described in the aforementioned French document.

The stabilizing device according to the invention is linked to an inflatable structure of a generally substantially elongated cylindrical shape, capable of being inflated with a view to its displacement and pulled along by a motorised engine. It comprises at least one pair of flexible ballasts which extend laterally along the length of the said inflatable structure and which are mounted on the structure in such a way as to be able to sink in the water simultaneously. The ballasts each comprise an orifice acting as a vent, located at the front, and a scoop system, located at the rear, with, between the rear ends of these ballasts, at the rear of the said scoop system, a pipe which links the cavities of the said ballasts in order to equalize the load and/or the total pressure of the water which reigns in the said cavities when the structure is pulled along. The cavities, when filling with water, act the role of a keel and are able to play the part of a hull in the manner of a catamaran or other, without necessarily playing the part of floats, which remains in any case with the said inflatable structure.

The ballasts are provided in the form of elongated fenders which are integral with the inflatable structure, over at least a part of their length. The ballasts are made of a flexible watertight fabric having, for example, a diameter in the order of 30 to 40 cm, in relation with that of the inflatable structure. Each fender can comprise one or more compartments, the compartments being each provided with their own scoop system. The cavities of each pair of compartments are located at the same level over the length of the said structure and are connected by a pipe to equalize the pressure and the refilling level.

According to the present invention, the junction between each equalizing pipe and the compartment of the corresponding ballast comprises a non-return valve in such a way as to place, at the level of the said equalizing pipes, elements which are capable of maintaining a geometrical shape which is adapted to their function.

According to a first embodiment of the invention, the scoop system is comprised of a scoop moulded from a rigid or semi-rigid thermoplastic material. The scoop is bonded and/or welded at the level of an orifice formed in the fabric of each ballast or each compartment, at its rear part.

According to the invention, the scoop which is made of thermoplastic material is provided in the form of a bent part which may comprise a non-return valve located at its inlet, for example.

According to another embodiment of the invention, the scoop system is comprised of an assembly of cut-outs made from a flexible material of the watertight fabric type, and more particularly several cut-out templates which are firstly assembled together by bonding and/or by welding;

- a first template which makes it possible to form three layers of fabric in order to produce the part corresponding to the sides of the scoop proper, one of the layers being placed head to tail between the other two;
- a second cut-out template which forms a fourth layer of fabric for the sides of the scoop and which partially caps the three preceding layers, and
- a third cut-out template which forms a reinforcement to cover the downstream part of the first cut-out template which is not covered by the second cut-out template.

Still according to the invention, the first cut-out template comprises three parts:

- a central part which corresponds to the two sides of the scoop proper, the sides are of triangular shape and they are connected to one another by a common web,
- a lateral part which forms a large sill, which large sill extends upstream and downstream of the web which links it to the said side of the scoop,
- another lateral part which forms a small sill, set opposite the large sill in relation to the sides of the scoop, the said small sill extends solely upstream of the web which connects it to the other side of the scoop.

The second cut-out template comprises three parts;

- a central part which corresponds to the two sides of the scoop proper, the sides are of triangular shape and they are connected to one another by a common web,
- two identical lateral parts placed either side of the central part and which each form a sill, the sill extends upstream of the web which connects it to the corresponding side of the scoop, and the surface of the sills of this second cut-out template is substantially higher than that of the small sill of the first cut-out template.

According to another design of the invention, the third cut-out template, of substantially rectangular shape, has a surface area which corresponds to twice the surface area of the downstream part of the large sill of the first cut-out template.

According to the invention, the scoop system comprises, in the ballast, covering the orifice of the scoop proper, a non-return valve comprised of a flexible member which is fixed on the interior surface of the wall of the said ballast, the flexible member, of fabric, is fitted at the level of the orifice, welded or bonded just upstream of this orifice.

The invention equally relates to the process of producing this scoop system, of flexible material as detailed above. The process consisting of:

- arranging the three pieces which make up the first cut-out template, one above the other, of which one is placed head to tail between the other two,
- overlapping the said three pieces with a piece which corresponds to the second cut-out template,
- bonding and/or welding the four pieces by separating the downstream parts which form part of the first cut-out template,
- increasing the volume of the said scoop proper,
- assembling by bonding and/or welding the upstream part of the sills of the pieces corresponding to the first cut-out template and to the second cut-out template,
- assembling by bonding and/or welding the piece which corresponds to the third cut-out template, on the downstream part of the sills of the pieces which make up the first cut-out template.

Still according to the invention, the process consists in:

- creating in the fabric of the ballast an opening of triangular shape with its tip turned towards the downstream part of the said ballast,
- bonding and/or welding the scoop system on the internal face of the fabric which makes up the ballast.

BRIEF DESCRIPTION OF THE FIGURES

In order to be able to be implemented, the invention is explained in a sufficiently clear and complete manner in the following description which is also accompanied by the drawings in which:

FIG. 1 shows diagrammatically an inflatable structure according to the invention, which is pulled along, in the inflated state by a boat;

FIG. 2 shows the appearance of the ballasts when the inflated structure is taken out of the water;

FIG. 3 is a view from above of the two ballasts filled with water, without the inflatable structure, the ballasts forming a double keel, or hull, of the catamaran type;

FIG. 4 shows an elevation, rear view, of the inflated structure, with its two ballasts filled with water;

FIG. 5 shows a view from below of the ballasts filled with water, without the inflatable structure;

FIG. 9 shows another embodiment of the scoop system which likewise has an integrated non-return valve;

FIGS. 10 and 11 show a variation for forming the stabilizing device of an inflatable structure;

FIG. 12 shows the installation of a non-return valve level with the junction between the pipe which connects the ballasts and the said ballasts;

FIG. 19 shows the regrouping of the second cut-out template with the regrouping of the three pieces shown in FIG. 11;

FIG. 20 shows a third cut-out template;

FIG. 21 shows after increasing the volume of the scoop proper, the regrouping of the third cut-out template with the previous regrouping shown in FIG. 19;

FIG. 22 is a side view of the scoop system;

FIG. 23 is front view of the scoop system.

DETAILED DESCRIPTION OF THE FIGURES

Figure 6:
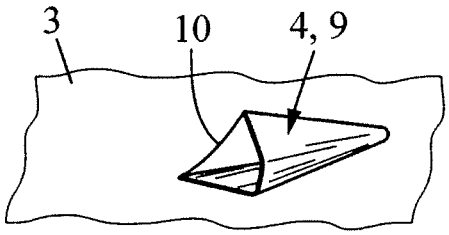
FIG. 6 shows, according to a first embodiment, a scoop system which projects at the surface of the external wall of the ballast.

FIG. 1 shows an inflatable structure 1 which in the inflated state is pulled along by a motor-type boat 2. This inflatable structure 1, with compressed air, for example, is provided in the form of a large elongated cylinder whose diameter can be for example in the order of 2 meters or more. This cylinder is made by means of a flexible watertight fabric and it can comprise, as shown in the drawing, several compartments, for example three compartments.

In order to stabilize this inflatable structure 1 on water, there are ballasts 3 which extend over all or part of the length of the cylinder and in particular along the generatrices of this cylinder. The ballasts 3 are for example two in number and they are spaced out transversally.

The ballasts 3 may have a fender-type shape whose cover is equally formed from a watertight flexible fabric, preferably from the same fabric as that used to make the inflatable structure.

The ballasts 3 may be fitted on the wall of the cylinder forming the inflatable structure 1 by bonding or the like. These ballasts 3 are for example installed on the inflatable structure 1 according to the generatrices whose angular position a, in relation to the centre of the cylinder, is in the order of 90°, as shown in FIG. 2 where the said inflatable structure 1 is shown face on.

In this embodiment, the two ballasts 3 are in fact placed on the external surface of the inflatable structure 1 in such a way that they can both sink simultaneously in the water.

As shown in FIG. 2, the ballasts 3 hang down laterally beneath the inflatable structure 1 when this inflatable structure 1 is for example suspended out of water.

FIG. 3 shows the two ballasts 3, without the inflatable structure 1. The ballasts 3 extend parallel over the entire length of the cylinder which makes up the inflatable structure 1 and they form a type of catamaran with a twin hull, but with the difference that this twin hull does not float and that rather it plays the part of a ballasted keel.

The connection between the ballasts 3 and the inflatable structure 1 is formed by bonding or by any other suitable assembly means.

In order to fulfil their function of ballast and stabilization, the ballasts 3 comprise, as shown in FIG. 4, and in more detail in FIGS. 5 to 9, a scoop system 4 which allows water to be introduced automatically when the inflatable structure 1 is pulled along, in the inflated state, by a motor boat 2.

FIG. 5 shows the ballasts 3 viewed from below, with each scoop system 4 at their rear part which corresponds to the prow of the inflatable structure 1.

The cavities of the two ballasts 3 can preferably be connected to one another at their rear end by a pipe 5. This pipe 5 allows in particular their level of fill to be equalized as well as the total pressure of the water which prevails in the cavities of the ballasts 3 in order to stabilize the inflatable structure 1 on the water when it is being moved, pulled along by the motorboat 2.

As illustrated in FIGS. 1 and 3, in order to enable their integral filling, the ballasts 3 comprise at their front part, level with the prow, an orifice 6 having a small diameter and acting as a vent. The orifice 6 enables the evacuation of any air which may be contained in the ballast 3.

FIG. 5 also shows, represented by dotted lines, an embodiment for providing compartments in each ballast 3. As shown in FIG. 5, each ballast 3 comprises two compartments 7 and 8; each pair of compartments placed at the front, or at the rear, is connected by a pipe for equalizing the pressures. The pair of compartments 7, located at the front, is connected by a pipe 5' which is located substantially at the rear of the scoop systems 4' set at the rear end of this front pair of compartments.

Still in the case of FIG. 5, the front part of the pair of compartments 8 located at the rear comprises a vent 6', shown in FIG. 1. This vent 6' is comprised of a single small orifice which enables an automatic escape of the air contained in the cavity of the ballast 3 gradually in proportion to the filling of the corresponding compartment with the scooped water.

The equalizing pipes 5, 5' which connect the ballasts 3 can be of different shapes, as detailed later on in conjunction with FIGS. 10 to 14.

FIG. 6 shows the protruding part of a first scoop system 4. The scoop system is comprised of a scoop 9 which appears projecting over the lower exterior surface of the wall of a ballast 3. This scoop 9 is positioned in an orifice 10 having a triangular shape which is mounted in the flexible wall of the ballast 3, in an area which allows the scoop 9 to submerge as soon as the inflatable structure 1 is placed on the water.

Figure 7:
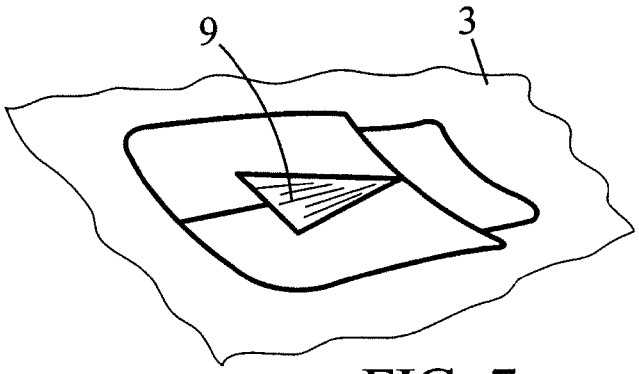
FIG. 7 shows the scoop system of FIG. 6 mounted on the internal surface of the wall of a ballast.

FIG. 7 shows the internal face of the flexible wall of the ballast 3 with, bonded on its internal surface. The scoop 9 is comprised, as detailed later on in FIGS. 15 to 23, of an assembly of cut-outs formed in a flexible watertight fabric, of the type which makes up the said ballasts 3.

Figure 8:
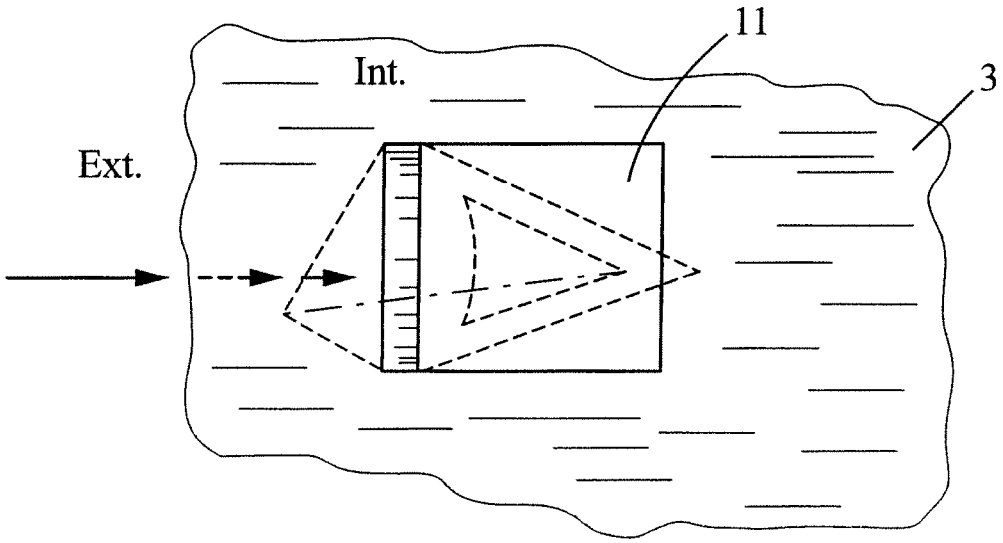
FIG. 8 shows a non-return valve linked to the scoop system which is shown in FIGS. 6 and 7.

FIG. 8 shows a particular embodiment of the scoop system which is fitted with a non-return valve. This scoop system comprises a flexible piece 11 fixed on the interior surface of the wall of the ballast 3. The piece being installed level with the orifice 10, welded or bonded just upstream of the opening, coming to cover this opening of the scoop in the said ballast 3.

FIG. 9 shows a variation of the embodiment of the scoop system 4. This scoop system is comprised of a rigid scoop 12, formed of a thermoplastics material, for example. It has the shape of a crank and it is fixed to the ballast 3 level with a cut-out 10' by any suitable means. This scoop 12 comprises a non-return valve 13 which is placed level with its inlet, for example; this valve 13 allows the water to be retained in the corresponding ballast 3, as in the case of the scoop 9 fitted with the flap 11, shown in FIG. 8.

FIGS. 10 to 14 show an alternative embodiment of the equalizing pipes 5 and 5' which become the true structural elements, under pressure, to support the load 1 of the inflatable structure 1. These equalizing pipes 5 and 5' can maintain a geometrical shape adapted to their function, in the form of girders, if they are fitted with anti-return valves level with their connection to each ballast 3.

FIG. 12 shows a valve 14, of the non-return valve type, installed level with the connection between a ballast 3 and an equalizing pipe 5, or 5', the said valve 14 enabling the passage in the travel sense of the said ballast 3 towards the interior of the pipe 5, or 5'.

Figure 13:
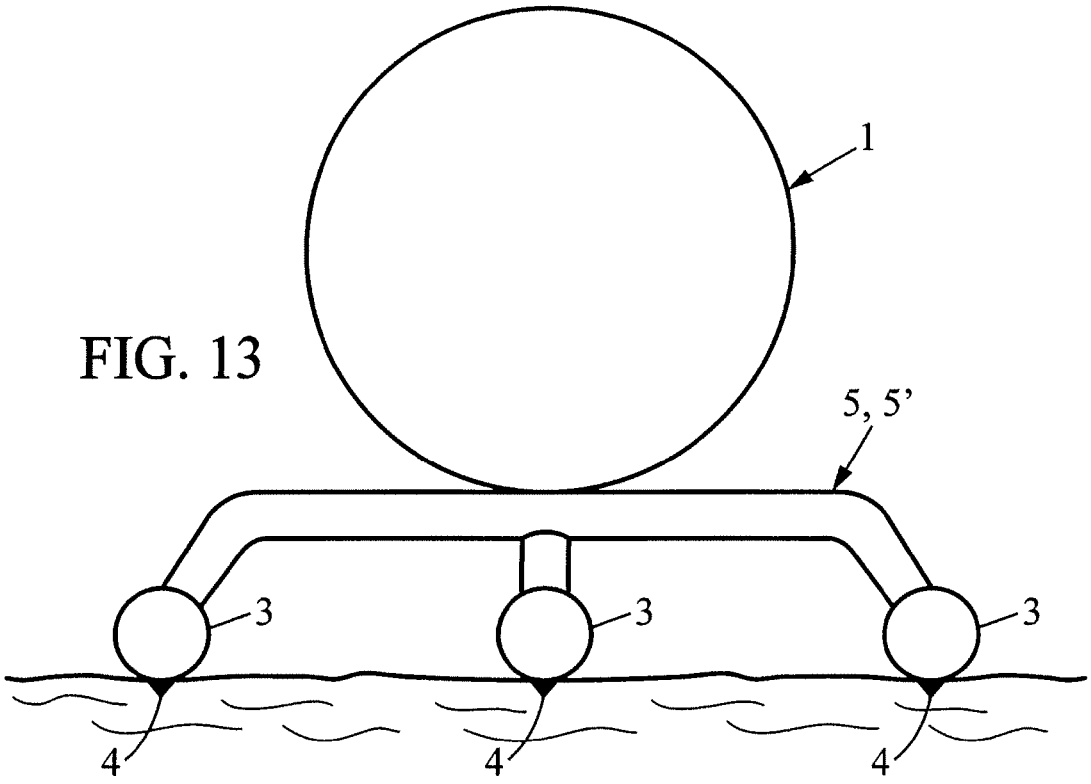
FIGS. 13 and 14 show a stabilizing device of an inflatable structure, in the form of a trimaran.
Figure 14:
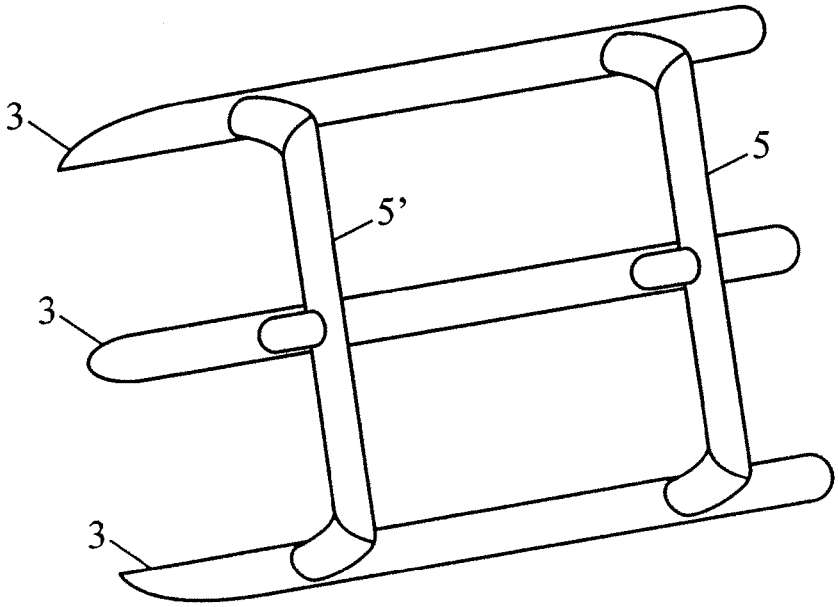

The stabilizing device shown in FIGS. 10 and 11 is similar to a catamaran. It can equally have the form of a trimaran in order to carry and support more significant inflatable structures, as shown in FIGS. 13 and 14. Three ballasts 3 are connected to one another by the equalizing pipes 5, 5' and one inflatable structure 1 rests in the inflated state on the said pipes 5, 5', lashed by suitable means.

The scoop system 4 which is comprised of the scoop 9, as detailed in the following FIGS. 15 to 23, is made from several pieces which are cut out in the flexible watertight fabric of the type used for making the ballasts 3.

Figure 15:
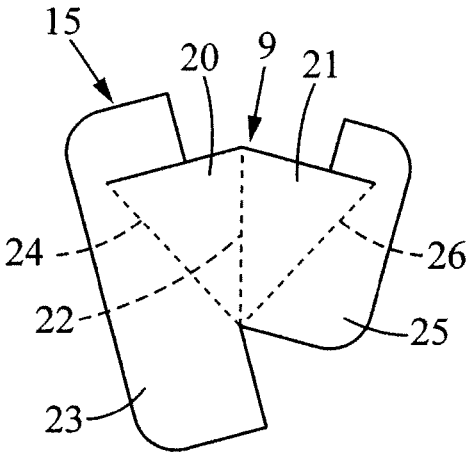
FIGS. 15 and 16 show the first cut-out template which enables the shaping of the scoop system.
Figure 16:
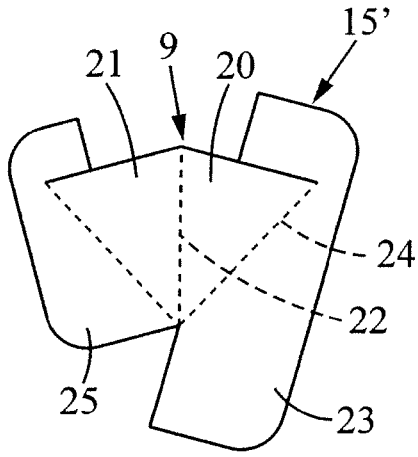

FIG. 15 shows a first cut-out template 15 and FIG. 16 shows an identical template 15' which has merely been presented in the way that it is assembled with two templates 15, that is head to tail between these two templates 15, in order to provide the method of making the scoop system 4.

Figure 17:
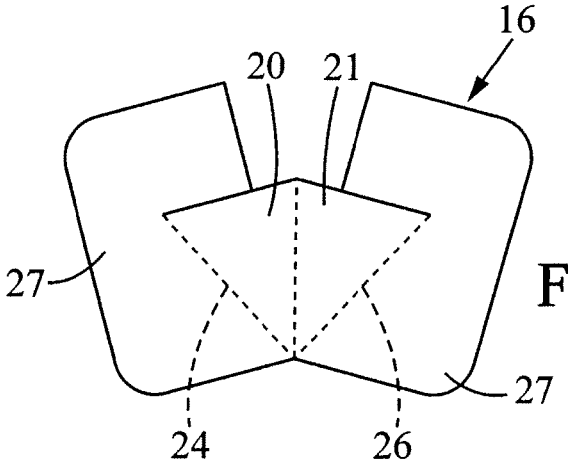
FIG. 17 shows a second cut-out template used to make up the scoop system.

FIG. 17 shows another piece of the scoop system 4, which piece constitutes a second cut-out template 16. FIG. 20 shows also another piece which corresponds to a third cut-out template 17.

Figure 18:
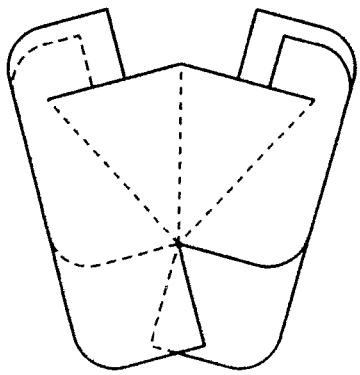
FIG. 18 shows the regrouping of the three pieces which make up the first cut-out template.

In order to make this scoop system 4, the three pieces of the first cut-out template 15, 15' as shown in FIG. 18, are gathered to which is added the second cut-out template 16 which is shown in FIG. 17 which gives a first regrouping of four pieces as shown in FIG. 19.

The first cut-out template 15, 15' comprises two triangular zones which correspond respectively to the sides 20 and 21 of the scoop 9 proper, the said sides 20 and 21 being connected to one another by a common web 22. A large sill 23 extends along the side 20 with a common web 24 and a small sill 25 extends along the side 21 with a common web 26. The large sill 23 extends upstream and downstream of the side 20 whilst the sill 25 extends solely upstream of the side 21, that is to say upstream of that which corresponds to the inlet of the scoop 9.

The second cut-out template 16, shown in FIG. 17, itself also comprises the sides 20 and 21 which make up the scoop 9 proper, and it equally comprises the sills 27 which have an identical shape, connected by the webs 24 and 26 to the sides 20 and 21 respectively.

The sills 27 of this second cut-out template 16 extend solely upstream of the sides 20 and 21 and their surface area is substantially greater than that of the small sills 25 of the first cut-out template 15, 15'.

The first cut-out templates 15, 15' are assembled together flat as shown in FIG. 18, by using three pieces: two templates 15 and one template 15' installed head to tail between the other two.

In this configuration, FIG. 18, the scoop system 4 corresponds to a regrouping and to an assembly, by bonding and/or welding, of the three pieces taking care to separate the large sills 23 and in particular their downstream part in order to avoid their welding.

This first regrouping of the first cut-out templates 15 and 15' is then completed with the second cut-out template 16, as shown in FIG. 19 and the assembly is again bonded and/or welded in order to form the scoop system 4, still flat.

The volumizing of this regrouping of the first and second cut-out templates, as shown in FIG. 21, has the effect of producing the scoop 9 proper, that is to say closing up the angle formed by the webs 24 and 26 of the sides 20 and 21 and bringing closer the upstream sills of the pieces corresponding to the first cut-out template 15, 15' and of the piece corresponding to the second cut-out template 16.

The third cut-out template 17 is bonded over the downstream parts of the large sills 23 of the first cut-out templates 15, 15' in order to reinforce this part which is located at the rear of the scoop 9.

At the front of the scoop 9, the upstream parts of the sills 23, 24 and 27 can be bonded and/or welded to fix the shape of the scoop 9 proper.

By being made from cut-outs of a flexible and watertight fabric of the type which makes up the ballasts 3, the scoop system 4 is relatively flexible which enables the said ballasts 3 likewise to maintain a certain flexibility, particularly when they are totally inactive away from the water.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A device for stabilizing an inflatable structure of a generally substantially cylindrical elongated shape capable of being pulled along in the inflated state, said device comprising at least one pair of flexible ballasts which extend laterally over at least a part of the length of said inflatable structure and which are arranged in order to sink into the water simultaneously, each ballast comprising an orifice acting as a vent, situated at the front of said ballast, and a scoop system situated at the rear of said ballast, with between the rear ends of said ballasts, at the rear of said scoop system, a pipe which connects cavities of said ballasts in such a way as to equalize a fill of the water and the total pressure of the water in said cavities when the inflatable structure is pulled along, wherein said scoop system is comprised of an assembly of cut-outs made in a flexible material of a watertight type of fabric, and including three cut-out templates which are first of all assembled together by bonding or by welding; and which include:

a first cut-out template which allows three layers of fabric to be formed to produce a part corresponding to sides of a scoop proper, one of said layers being arranged head to tail between the other two;

a second cut-out template which forms a fourth layer of fabric for said sides of said scoop and which caps partially the three preceding layers and, a third cut-out template which acts as reinforcement to cover a downstream part of said first cut-out template which is not covered by said second cut-out template.

2. The stabilizing device for the inflatable structure according to claim 1 wherein the ballasts are present in the form of elongated fenders fitted over substantially the entire length of the inflatable structure , said ballasts being made of a flexible watertight fabric, and each fender can comprise one or more compartments, said compartments each being provided with a scoop system and cavities of each pair of compartments located at the same level over the length of the inflatable structure are connected by a pipe for equalizing the pressure and equalizing the fill.

3. The stabilizing device for the inflatable structure according to claim 2 wherein a junction between each equalizing pipe and each corresponding ballast comprises a non-return valve so as to provide at the level of said equalizing pipes elements capable of maintaining a geometrical shape which is adapted to their function.

4. The stabilizing device for the inflatable structure according to claim 1 wherein said scoop system is comprised of a scoop moulded from a rigid or semi-rigid thermoplastic material, said scoop being bonded or welded level with an orifice formed in the fabric of each ballast, or each compartment, at a rear part thereof.

5. The stabilizing device for the inflatable structure according to claim 4 wherein said scoop of thermoplastic material is provided in the form of a cut-out piece which comprises a non-return valve located at an inlet of said scoop.

6. The stabilizing device for the inflatable structure according to claim 1 wherein said first cut-out template comprises three parts:

a central part which corresponds to two sides of said scoop proper, said sides being of triangular shape and being connected to one another by a common web, a lateral part which forms a large sill, said large sill extending upstream and downstream of a web which connects said large sill to one side of said scoop; and another lateral part which forms a small sill, located opposite said large sill in relation to said sides of said scoop, said small sill extending solely upstream of a web which connects said small sill to the other side of said scoop.

7. The stabilizing device for the inflatable structure according to claim 6 wherein said second cut-out template comprises three parts:

a central part which corresponds to two sides of said scoop, said sides being of triangular shape and being connected to one another by a common web; and two identical lateral parts placed either side of said central part and each forming a sill, which sill extends upstream of a web which connects said sill to a corresponding side of said scoop and the surface area of the sills of said second cut-out template is substantially greater than the surface area of said small sill of said first cut-out template.

8. The stabilizing device for the inflatable structure according to claim 6 wherein said third cut-out template, of substantially rectangular shape, has a surface area which corresponds to double the surface area of a downstream part of said large sill of said first cut-out template.

9. The stabilizing device for the inflatable structure according to claim 1 wherein said scoop system comprises in said ballast, covering a through orifice of said scoop proper, a non-return valve comprised of a flexible piece which is fixed on an interior surface of a wall of said ballast, said flexible piece, of fabric, is installed level with said through orifice and is welded or bonded just upstream of said through orifice.

10. A method for implementing a scoop system of a stabilizing device of an inflatable structure in which said scoop system is comprised of an assembly of cut-outs made in a flexible material of a watertight type of fabric, and including three cut-out templates which are assembled together by bonding or by welding, the templates are:

a first cut-out template which allows three layers of fabric to be formed to produce a part corresponding to sides of a scoop proper, one of said layers being arranged head to tail between the other two;

a second cut-out template which forms a fourth layer of fabric for said sides of said scoop and which caps partially the three preceding layers and, a third cut-out template which acts as reinforcement to cover a downstream part of said first cut-out template which is not covered by said second cut-out template;

the method consisting in:

placing three pieces of fabric which make up said first cut-out template one on top of the other, with one piece being placed head to tail between the other two pieces;

overlaying said pieces with a piece of fabric which corresponds to the second cut-out template;

bonding or welding the four pieces by separating the downstream parts which form part of said first cut-out template;

volumizing said scoop proper;

assembling by bonding or welding upstream sills of the pieces corresponding to said first cut-out template and second cut-out template; and assembling by bonding or welding the piece which corresponds to said third cut-out template, on a downstream part of the downstream sills of the pieces making up said first cut-out template.

11. The method for implementing a scoop system according to claim 10 further consisting in:

forming in the fabric of said ballast an opening of triangular shape with the tip turned towards the downstream part of said ballast; and bonding or welding said scoop system on an internal face of the fabric which makes up said ballast.

* * * * *